US009889661B2

(12) United States Patent
Kinoshita et al.

(10) Patent No.: US 9,889,661 B2
(45) Date of Patent: Feb. 13, 2018

(54) LIQUID EJECTING HEAD AND MANUFACTURING METHOD FOR LIQUID EJECTING HEAD

(71) Applicant: SEIKO EPSON CORPORATION, Tokyo (JP)

(72) Inventors: Ryota Kinoshita, Matsumoto (JP); Masahisa Nawano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/462,368

(22) Filed: Mar. 17, 2017

(65) Prior Publication Data

US 2017/0282552 A1 Oct. 5, 2017

(30) Foreign Application Priority Data

Apr. 4, 2016 (JP) ..... 2016-074968

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/175; B41J 2/17513; B41J 2/14201
See application file for complete search history.

(56) References Cited

U.S. PATENT DOCUMENTS

2010/0253752 A1* 10/2010 Miyajima ..... B41J 2/17596 347/85
2012/0162322 A1 6/2012 Tsuchiya et al.
2015/0042726 A1* 2/2015 Enomoto ..... B41J 2/14201 347/68
2017/0282558 A1* 10/2017 Miyajima ..... B41J 2/14201

FOREIGN PATENT DOCUMENTS

JP 2008-055838 3/2008
JP 2010-266485 11/2010
JP 2012-131152 7/2012

* cited by examiner

*Primary Examiner* — Lamson Nguyen
(74) *Attorney, Agent, or Firm* — Workman Nydegger

(57) ABSTRACT

A liquid ejecting head includes a liquid ejecting unit that has a nozzle surface to which the nozzle is open, a base member to which the liquid ejecting unit is fixed, and a cover member that is attached to the base member and on which a laminated member is laminated, in which the cover member has a fixing portion to which the laminated member is fixed and a fragile portion that has lower rigidity than the fixing portion, and is attached to the base member by fixing the fragile portion to the base member.

17 Claims, 9 Drawing Sheets

LIQUID EJECTING HEAD AND MANUFACTURING METHOD FOR LIQUID EJECTING HEAD

The entire disclosure of Japanese Patent Application No: 2016-074968, filed Apr. 4, 2016 is expressly incorporated by reference herein in its entirety.

BACKGROUND

1. Technical Field

The present invention relates to a liquid ejecting head such as an ink jet recording head that ejects liquid from a nozzle and a manufacturing method for the liquid ejecting head.

2. Related Art

For example, there is an image recording apparatus such as an ink jet printer or an ink jet plotter as a liquid ejecting apparatus on which a liquid ejecting head is mounted, but the liquid ejecting head is also applied to various manufacturing apparatuses by taking advantage of a recent feature in which it is possible to accurately land a very small amount of liquid at a predetermined position. For example, the liquid ejecting head is applied to a display manufacturing apparatus which manufactures a color filter of a liquid crystal display or the like, an electrode forming apparatus which forms an electrode of an organic electro luminescence (EL) display, a field emission display (FED), or the like, and a chip manufacturing apparatus which manufactures a bio chip (bio-chemical element). Then, a recording head for the image recording apparatus ejects liquid ink, and a color material ejecting head for the display manufacturing apparatus ejects solution of each color material of red (R), green (G), and blue (B). In addition, an electrode material ejecting head for the electrode forming apparatus ejects a liquid electrode material, and a bio-organic material ejecting head for the chip manufacturing apparatus ejects a bio-organic material solution.

The liquid ejecting head is provided with a liquid ejecting unit that is provided with a nozzle that ejects liquid, a pressure chamber that links with the nozzle, a piezoelectric element (type of an actuator) that generates pressure variation in liquid within the pressure chamber, and the like, a base member to which the liquid ejecting unit is fixed, and a flow path member that supplies liquid to the pressure chamber of the liquid ejecting unit. Here, the flow path member has an internal flow path and is formed using resin (synthetic resin). Therefore, during formation, there is a concern that warping is generated in the flow path member. In particular, the flow path member that is attached to the liquid ejecting head provided with a plurality of liquid ejecting units tends to be long and warping tends to occur. Therefore, a component is disclosed that is configured such that the flow path member is attached to a reinforcing member and warping of the flow path member is corrected (for example, JP-A-2012-131152). Then, the reinforcing member is attached to a base member by a screw and the like at a plurality of locations.

Note that, the reinforcing member has rigidity to the extent that warping of the flow path member is able to be corrected. Therefore, when the reinforcing member is attached to the base member by the screw and the like, there is a concern that the base member is distorted in response to reaction force that is received from the reinforcing member.

When the base member is distorted, there is a concern that the posture of the liquid ejecting unit is changed and the position of the nozzle is deviated from a prearranged position. As a result, there is a concern that a landing position of liquid droplets that are ejected from the nozzle toward the recording medium is deviated from the prearranged position.

SUMMARY

An advantage of some aspects of the invention is to provide a liquid ejecting head that is able to suppress distortion of a base member while correcting warping of a laminated member such as a flow path member, and a manufacturing method for a liquid ejecting head.

According to an aspect of the invention, there is provided a liquid ejecting head including a liquid ejecting unit that has a nozzle surface to which the nozzle is open, a base member to which the liquid ejecting unit is fixed, and a cover member that is attached to the base member and on which a laminated member is laminated, in which the cover member has a fixing portion to which the laminated member is fixed and a fragile portion that has lower rigidity than the fixing portion, and is attached to the base member by fixing the fragile portion to the base member.

According to the aspect of the invention, even if the laminated member is distorted, it is possible to correct distortion of the laminated member using the fixing portion. Thereby, connection of the laminated member and another member that is connected to the laminated member is easy. For example, even in a case where the laminated member has a plurality of protruding parts and the plurality of protruding parts are connected to another member, connection of the laminated member and another member is easy since a position of each protruding part with respect to the other member tends not to be deviated. In addition, in a case where a liquid flow path is formed along which the liquid flows inside the laminated member, it is possible to suppress air bubbles remaining in the liquid flow path since distortion of the liquid flow path is suppressed. Furthermore, it is possible to suppress the reaction force that is generated by fixing since the cover member is fixed to the base member by the fragile portion. Thereby, it is possible to suppress force that is applied to the base member and it is possible to suppress distortion of the base member. As a result, it is possible to suppress positional deviation of the liquid ejecting head.

In addition, in the configuration described above, it is desirable that the cover member have side surfaces that face each other interposing the base member therebetween, the fixing portion be formed between the side surfaces that face each other, the fragile portion be formed on the side surfaces, and a gap between side surfaces that face each other be larger than the width of the base member that is interposed between the side surfaces.

According to the configuration, when the base member is inserted between the side surfaces and the cover member is fixed to the base member, it is possible to easily insert the base member between the side surfaces. As a result, fixing of the cover member and the base member is easy.

Furthermore, in the configuration described above, it is desirable that the fragile portion that is formed on one side surface out of the side surfaces that face each other extend from the one side surface toward another side surface, and the fragile portion that is formed on the one side surface and the base member be fixed by a fixing member more at the other side surface side than the one side surface.

According to the configuration, it is possible to suppress the fixing member from protruding further to the outside of the opposite side of the other side surface than the one side surface. Thereby, it is possible to reduce the size of the liquid ejecting head.

In addition, in any of the configurations described above, it is desirable that the side surfaces that face each other be disposed with positions in a longitudinal direction of the base member deviated from each other, and the fragile portions be disposed uniformly along the longitudinal direction of the base member at each side surface.

According to the configuration, fixing of the cover member and the base member is stable since the fragile portions are fixed to the base member at uniform positions in the longitudinal direction at each side surface of the cover member. In addition, a degree of freedom of design increases since the positions in the longitudinal direction of the base member on both side surfaces may not be aligned.

Furthermore, in each of the configurations described above, it is desirable that the gap between the side surfaces that face each other be formed to become larger from the opposite side from the base member toward the base member side, and the fragile portions extend further outside than the end of the side surfaces on the base member side in a direction that is orthogonal to the nozzle surface.

According to the configuration, when the base member is inserted between the side surfaces and the cover member is fixed to the base member, it is possible to more easily insert the base member between the side surfaces. In addition, it is possible to suppress spread of the side surfaces since the fragile portions extend further outside than the end of the side surface. As a result, it is possible to further reduce the size of the liquid ejecting head.

In addition, in each of the configurations described above, it is desirable that a connection member be provided between the fixing portion and the base member, and the laminated member be connected to the connection member interposing the fixing portion therebetween.

According to the configuration, it is easy to connect the laminated member and the connection member. In particular, in a case where the laminated member has a plurality of protruding parts and the plurality of protruding parts are connected to the connection member, connection of the laminated member and the connection member is easy since a position of each protruding part with respect to the connection member tends not to deviate.

Furthermore, in any of the configurations described above, it is desirable to adopt a configuration in which a circuit board is provided that supplies a driving signal to the liquid ejecting unit, the cover member is formed of metal and has a surface along the circuit board, and the laminated member is provided with a liquid flow path along which liquid flows that is supplied to the nozzle.

According to the configuration, it is possible for heat that is generated in the circuit board to escape to the cover member. In addition, it is possible to cool the cover member using liquid that flows along the liquid flow path since the laminated member is provided with the liquid flow path. As a result, it is possible to effectively perform heat dissipation of the circuit board.

According to another aspect of the invention, there is provided a manufacturing method for a liquid ejecting head including a liquid ejecting unit that has a nozzle surface to which the nozzle is open, a base member to which the liquid ejecting unit is fixed, and a cover member that has a fixing portion to which a laminated member is fixed and a fragile portion that has lower rigidity than the fixing portion, the manufacturing method including fixing the laminated member to the fixing portion, and deforming the fragile portion to the base member side and fixing to the base member.

According to the aspect of the invention, even if the laminated member is distorted, it is possible to correct distortion of the laminated member using the fixing portion. In addition, it is possible to provide a gap for absorbing a dimensional error caused by a manufacturing error and the like between the base member and the fragile portion since the fragile portion is deformed to the base member side and fixed to the base member. Then, it is possible to suppress reaction force that is generated by deforming the fragile portion since the fragile portion has lower rigidity than the fixing portion. As a result, it is possible to suppress distortion of the base member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings. Note that, in the embodiments described below, there are various limitations as preferred specific examples of the invention, but the scope of the invention is not limited to these aspects unless particular limitations of the invention are otherwise stated in the explanation below. In addition, in the description below, an ink jet recording head (hereinafter, recording head) 3 that is mounted on an ink jet printer (hereinafter, printer) 1 which is one type of a liquid ejecting apparatus is given as an example of the liquid ejecting head of the invention.

Figure 1:
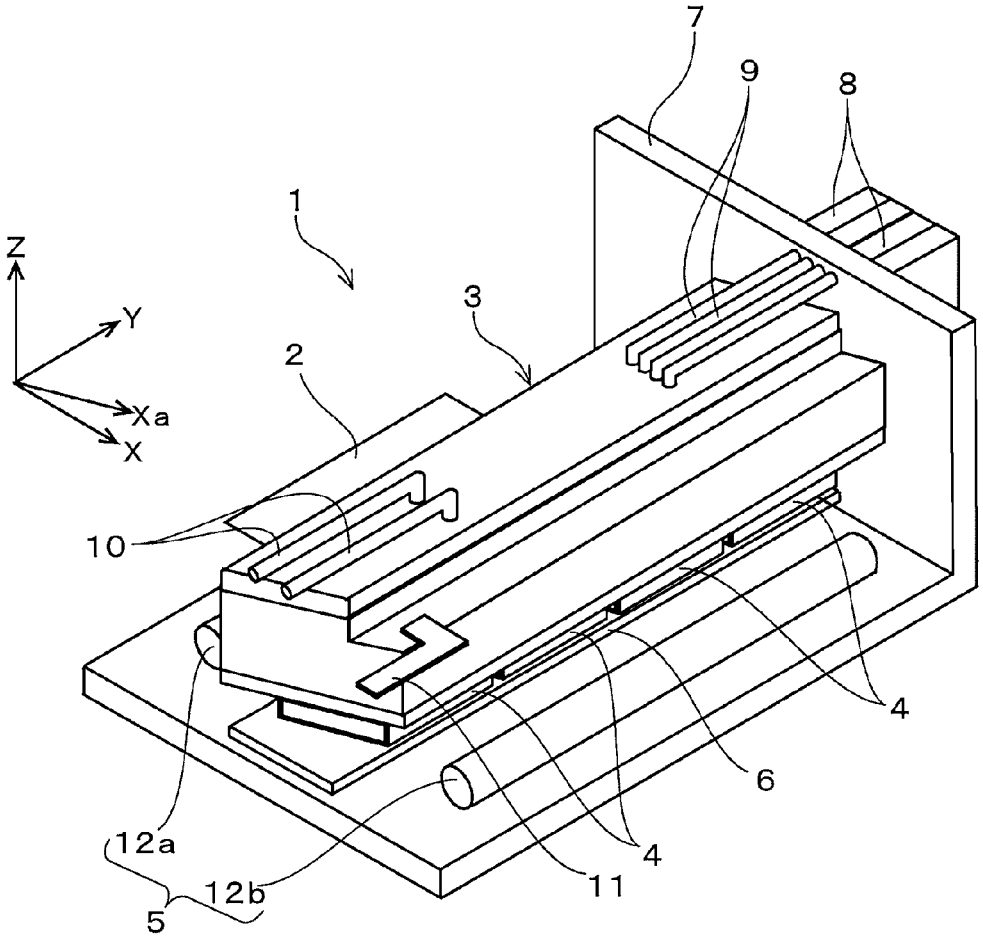
FIG. 1 is perspective view describing an internal configuration of a printer.

The configuration of the printer 1 will be described with reference to FIG. 1. The printer 1 is an apparatus which performs recording of an image or the like by ejecting ink in liquid form on the front surface of a recording medium 2 such as recording paper. The printer 1 is provided with the recording head 3 that is provided with a plurality of liquid ejecting units 4, a transport mechanism 5 that transports the recording medium 2, a medium support portion 6 (also referred to as a platen) that supports the recording medium 2 which is transported to a position facing a nozzle surface of the liquid ejecting unit 4, and the like in a casing 7.

The recording head 3 in the embodiment is a long line head in a direction (Y direction) in which a plurality (four in the embodiment) of liquid ejecting units 4 are attached lined up in the direction (Y direction in FIG. 1 and the like) which intersects with the transport direction (X direction in FIG. 1 and the like) of the recording medium 2. A liquid supply tube 9 that is linked inside an ink cartridge 8 in which ink that is a type of liquid is retained is connected to the recording head 3. Ink from the ink cartridge 8 is supplied to the recording head 3 via the liquid supply tube 9. Note that, it is also possible to adopt a configuration in which the ink cartridge is mounted on the recording head. In addition, a gas supply tube 10 that supplies gas (air in the embodiment) to the recording head using a pump which is not shown in the drawings and a wiring member 11 such as FFC that supplies a driving signal and the like from a control portion which is not shown in the drawings to the recording head 3 are connected to the recording head 3.

The transport mechanism 5 is provided with a first transport roller 12*a* that is disposed in an upper and lower pair further to the upstream side in the transport direction of the recording medium 2 than the medium support portion 6 and a second transport roller 12*b* that is disposed in the upper and lower pair further to the downstream side in the transport direction than the medium support portion 6. The recording medium 2 from the supply side is transported toward the discharge side to pass above the medium support portion 6 in a state of being interposed by the upper and lower roller by driving of the transport rollers 12*a* and 12*b*. Note that, in FIG. 1, illustration of the upper roller out of the upper and lower pair of rollers is omitted. In addition, the transport mechanism is constituted by an endless belt or a drum, and in such a configuration, the belt or the drum function as the medium support portion. Furthermore, as the medium support portion, it is also possible to adopt a configuration in which the recording medium is adsorbed by electrostatic force and a configuration in which the recording medium is adsorbed in response to generation of negative pressure.

Figure 2:
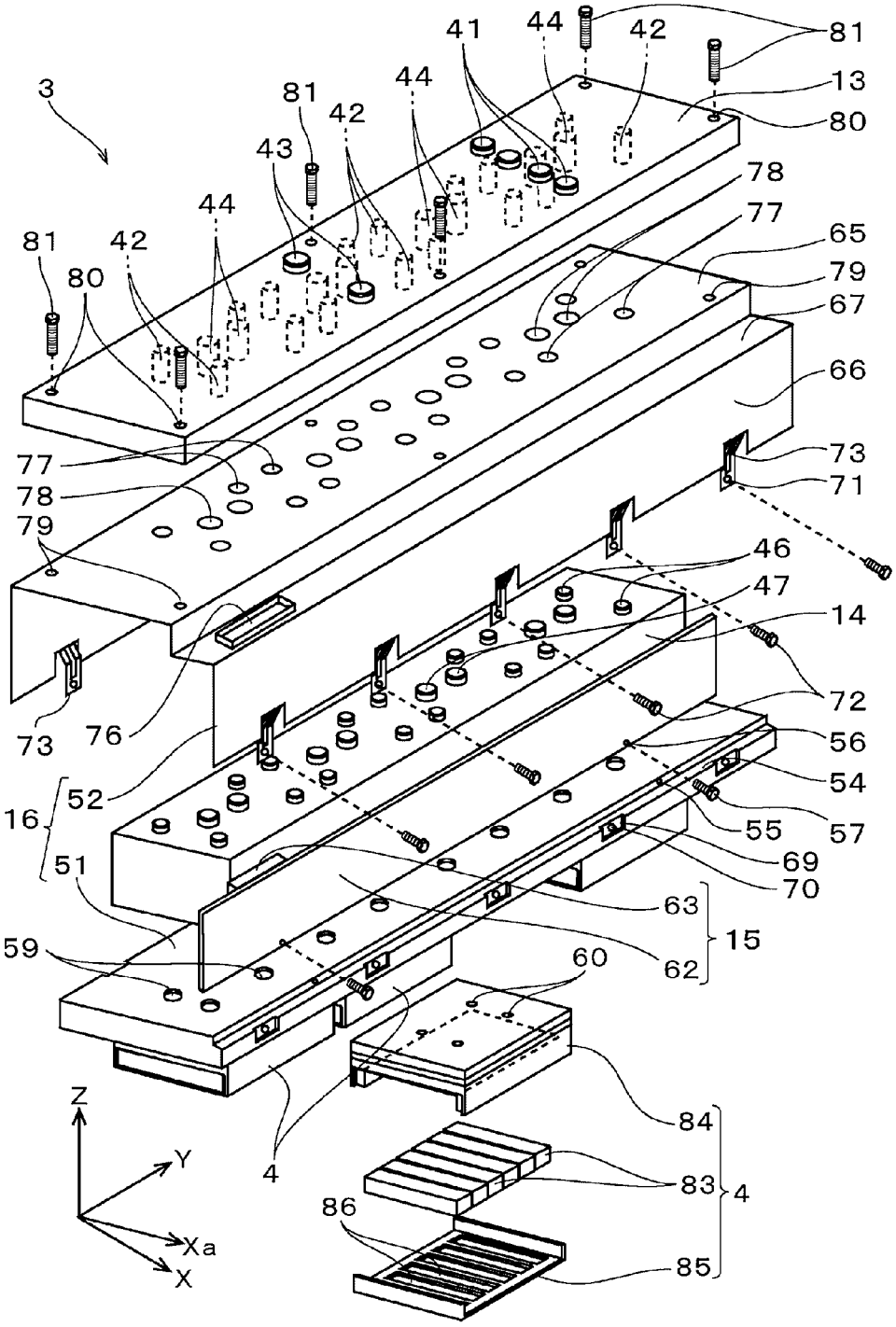
FIG. 2 is an exploded perspective view of a recording head viewed from obliquely above.
Figure 3:
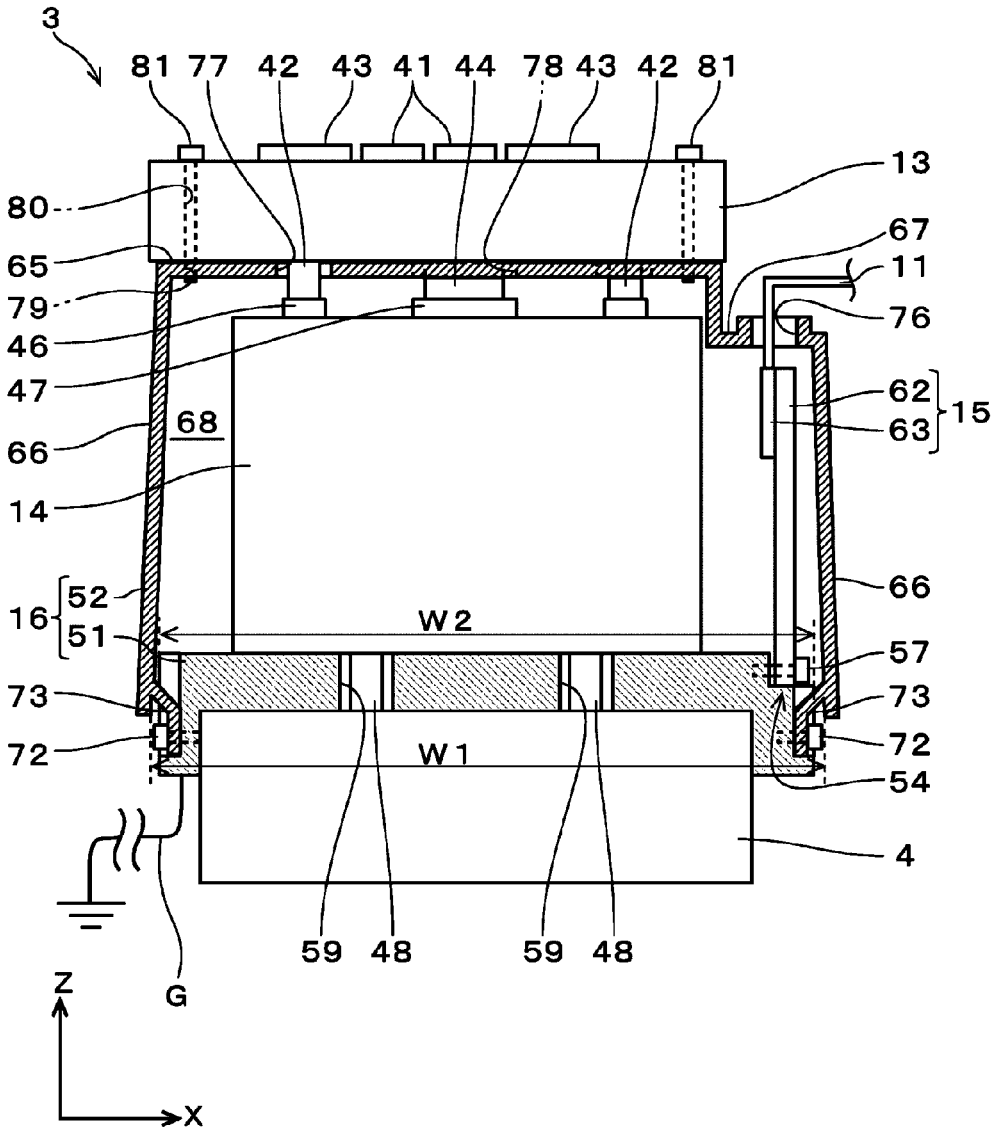
FIG. 3 is a sectional view of the recording head.
Figure 4:
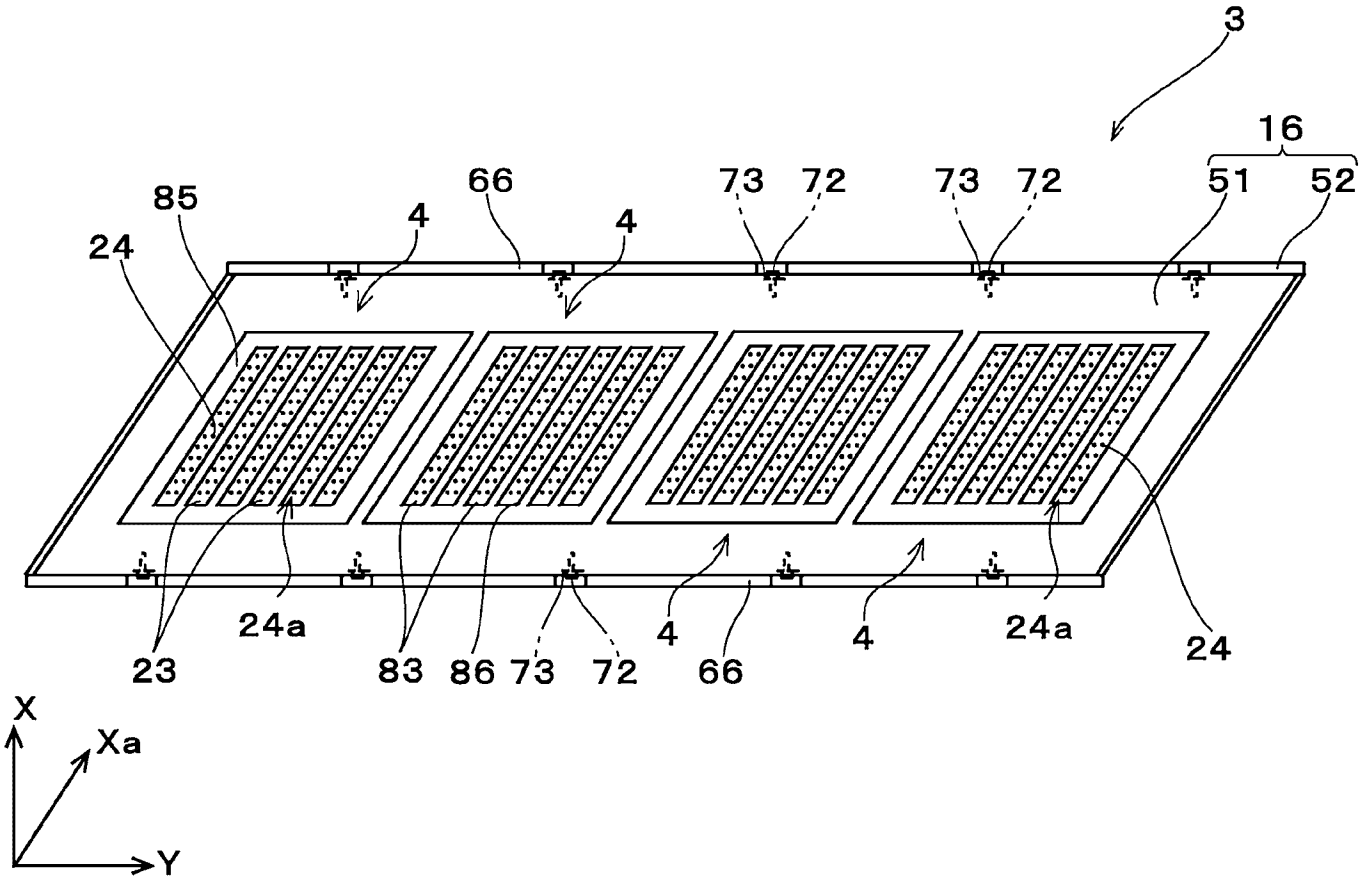
FIG. 4 is a bottom surface view of the recording head.

FIG. 2 is an exploded perspective view illustrating the configuration of the recording head 3. FIG. 3 is a sectional view of the recording head 3. FIG. 4 is a bottom surface view (or lower surface view) of the recording head 3. Note that, a lamination direction (Z direction) of each configuring member of the recording head 3 is described below as appropriate as in an up and down direction. As shown in FIGS. 2 and 3, the recording head 3 in the embodiment is provided with a flow path member 13 (one type of laminated member in the embodiment) on which a flow path that supplies ink to each liquid ejecting unit 4 is formed, a pressure adjustment member 14 (one type of connection member in the invention) that adjusts pressure of ink that flows internally, a circuit board 15 that transmits the driving signal that controls each liquid ejecting unit 4, a metal shield 16 that internally accommodates the pressure adjustment member 14 and the circuit board 15, and liquid ejecting units 4 that are fixed to a lower surface of a metal base 51 (one type of base member in the invention) that configures the bottom surface of the metal shield 16.

The flow path member 13 is formed internally by a liquid flow path along which ink flows and an air flow path along which air flows (neither shown in the drawings), and is a plate-like member made from a synthetic resin (for example, polypropylene (PP)) that supplies ink to each liquid ejecting unit 4. The flow path member 13 in the embodiment is fixed to (in other words, laminated to) an upper surface 65 of the metal cover 52 described later (one type of cover member in the invention). As shown in FIG. 2, a plurality of (four in the embodiment) liquid supply tube connecting portions 41 that are connected by the liquid supply tube 9 corresponding to each color are formed on the upper surface of the flow path member 13. The liquid supply tube connecting portions 41 are linked to a liquid outflow port 42 that is formed on the lower surface of the flow path member 13 via the liquid flow path inside the flow path member 13. The liquid flow path in the embodiment is branched in the middle such that ink that flows from one liquid supply tube connecting portion 41 is distributed to four liquid ejecting units 4, and four liquid outflow ports 42 are linked. That is, one liquid supply tube connecting portion 41 is linked to four liquid outflow ports 42 via the liquid flow path. In addition, a plurality of (two in the embodiment) gas supply tube connecting portions 43 that are connected by the gas supply tube 10 are formed on the upper surface of the flow path member 13. The gas supply tube connecting portions 43 are linked to a gas outflow port 44 that is formed on the lower surface of the flow path member 13 via the gas flow path inside the flow path member 13. The gas flow path in the embodiment is branched in the middle, and is linked to four gas outflow ports 44. That is, one gas supply tube connecting portion 43 is linked to four gas outflow ports 44 via the gas flow path.

Note that, a plurality of (in detail, eight) the gas outflow ports 44 in the embodiment are formed along the longitudinal direction (Y direction) of the flow path member 13 in substantially the center of a direction (X direction) which is orthogonal to the longitudinal direction (Y direction) of the flow path member 13. In addition, the liquid outflow ports 42 in the embodiment are respectively arranged side by side along the Y direction at both sides in the X direction of the columns of the gas outflow ports 44. That is, the columns of the liquid outflow ports 42 in which a plurality of (in detail, eight) liquid outflow ports 42 are arranged side by side are formed in two columns that interpose the column of the gas outflow ports 44. Furthermore, the liquid outflow ports 42 and the gas outflow ports 44 in the embodiment are formed in a cylindrical shape and protrudes downward from the lower surface of the flow path member 13. The diameter of the liquid outflow ports 42 are formed to be smaller than the diameter of the gas outflow ports 44. In addition, a flow path member through hole 80 through which the flow path member 13 passes through in the plate thickness direction is established at a center portion at four corners and in the longitudinal direction (Y direction) of the flow path member 13. As shown in FIG. 3, the flow path member 13 is fixed to the upper surface 65 of the metal cover 52 by fixing a flow path member fixing screw 81 to a flow path member fixing screw hole 79 that is formed on the upper surface 65 of the metal cover 52 through the flow path member through hole 80 in a state in which the bottom surface of the flow path member 13 is abutted to the upper surface 65 of the metal cover 52.

The pressure adjustment member 14 is a member made from synthetic resin that is connected below the flow path member 13 (liquid ejecting unit 4 side) that interposes the upper surface 65 of the metal cover 52 therebetween. The pressure adjustment member 14 is disposed between the upper surface 65 of the metal cover 52 and the metal base 51. A plurality of liquid inflow ports 46 that correspond to the liquid outflow ports 42 of the flow path member 13 and gas inflow ports 47 that correspond to the gas outflow ports 44 of the flow path member 13 are respectively formed on the upper surface of the pressure adjustment member 14. As shown in FIG. 3, a connecting portion of the liquid outflow ports 42 and the liquid inflow ports 46 and a connecting portion of gas outflow ports 44 and the gas inflow ports 47 are connected below (that is, within an accommodating space 68 which will be described later) the upper surface 65 of the metal cover 52. The liquid inflow ports 46 are linked to a liquid outflow pipe 48 that protrudes below the pressure adjustment member 14 via a liquid flow path which is not shown in the drawings that is formed inside the pressure adjustment member 14. Note that, the liquid flow path inside the pressure adjustment member 14 is configured to be able to pressurize ink within the liquid flow path in response to air that flows in from the gas inflow ports 47. Therefore, if gas is driven by a pump and sent to the pressure adjustment member 14 via the gas supply tube 10, the flow path member 13, and the gas inflow ports 47, it is possible to increase pressure within the liquid flow path, and thus, it is possible to increase pressure within the liquid ejecting unit 4. Then, for example, a cleaning operation and the like are performed in which the nozzle surface (that is, the lower surface of a nozzle plate 23) of the liquid ejecting unit 4 is wiped by a wiper which is not shown in the drawings and the like in a state in which ink is caused to overflow from each nozzle 24 by controlling pressure of ink within the liquid ejecting unit 4.

As shown in FIG. 3, the metal shield 16 is a member made from metal on which the accommodating space 68 is formed that internally accommodates the pressure adjustment member 14 and the circuit board 15. The metal shield 16 is provided with the metal base 51 that has high rigidity that is attached on the upper surface to the pressure adjustment member 14 and the circuit board 15 and fixed on the lower surface to the plurality of liquid ejecting units 4, and the metal cover 52 with a thin sheet shape that covers the pressure adjustment member 14 and the circuit board 15. The metal base 51 is a plate material along a long X-Y plane in the Y direction as indicated in FIG. 2. The metal base 51 in the embodiment consists of aluminum, and as shown in FIG. 4, is formed in a long parallelogram shape in the Y direction in planar view. In addition, the metal base 51 is grounded by being electrically connected to a ground line G indicated in FIG. 3. A plurality of base through holes 59 into which the liquid outflow pipes 48 of the pressure adjustment member 14 are inserted are established in a state of passing through the plate thickness direction in a region in which the pressure adjustment member 14 of the metal base 51 is fixed. As shown in FIG. 3, the liquid outflow pipes 48 of the pressure adjustment member 14 pass through the base through holes 59 and are connected to the liquid ejecting unit 4 (in detail, the liquid introduction inlet 60).

In addition, a step 54 in which an upper surface of the metal base 51 is lowered by one step is formed on an end portion on one side (right side in FIGS. 2 and 3) in the X direction of the metal base 51. As shown in FIG. 2, a circuit board fixing screw hole 55 for fixing the circuit board 15 that supplies the driving signal to the liquid ejecting unit 4 is established on the side surface of the step 54. Thereby, the circuit board 15 is fixed on the metal base 51 by fixing a circuit board fixing screw 57 to the circuit board fixing screw hole 55 through a substrate through hole 56 that is formed in the circuit board 15 in a state in which the circuit board 15 (in detail, a circuit base material 62) is mounted on the upper surface of the step 54 along the side surface (that is, the Y-Z plane) of the step 54. That is, the circuit board 15 in the embodiment is fixed in a state of being erected from the metal base 51 along the Y-Z plane. Accordingly, as shown in FIG. 3, in a state in which the metal cover 52 is attached to the metal base 51, the circuit board 15 is disposed along the side surface 66 on one side (step 54 side) of the metal cover 52. In other words, the side surface 66 on one side of the metal cover 52 is formed along the circuit board 15. Note that, the metal cover 52 and the circuit board 15 may not be disposed in parallel. That is, the circuit board 15 may be slightly inclined to the side surface 66 on one side of the metal cover 52. In short, "the circuit board 15 is disposed along the side surface 66" is not limited to a case where the circuit board 15 is lined up parallel to the side surface 66, and includes a case where the circuit board 15 is slightly inclined to the side surface 66.

Note that, a wiring that has a ground potential in the circuit board 15 and a metal base 51 are conducted by the circuit board fixing screw 57. In addition, the circuit board 15 is provided with the long circuit base material 62 in a Y direction on which a circuit and the like is formed for driving a piezoelectric element 32 that consists of the wiring and the like and a connector 63 that is connected to the wiring member 11 which is formed on the circuit base material 62. The connector 63 in the embodiment is an upper end portion of the circuit base material 62, and one connector 63 is disposed close to one side (left side in FIG. 2) in the Y direction. In addition, the connector 63 is disposed on one surface inside the circuit base material 62 (pressure adjustment member 14 side).

Figure 6:
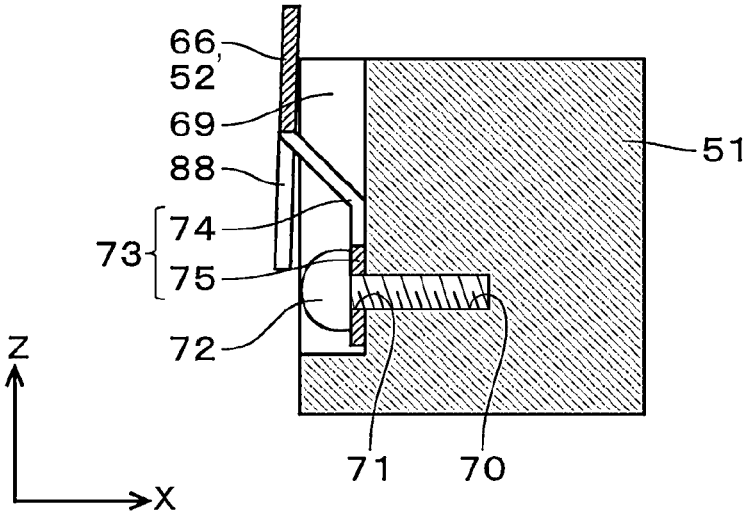
FIG. 6 is a sectional view of an enlarged fixing portion of a fragile portion of a metal cover and a metal base.

Furthermore, a concave portion 69 that is concave inside is formed on the side surface on both sides in the X direction of the metal base 51 (refer to FIGS. 2 and 6). The concave portion 69 is a space that accommodates fragile portions 73 which will be described later, and is formed at a position which corresponds to the fragile portions 73. Five concave portions 69 in the embodiment are arranged side by side on the respective side surfaces of the metal base 51. Then, a metal cover fixing screw hole 70 is established on the plane (that is, Y-Z plane) along the side surface in the concave portion 69.

The metal cover 52 is a long cover member in the Y direction that is formed in a state to cover spaced apart the pressure adjustment member 14 and the circuit board 15. The metal base 52 in the embodiment consists of an electrogalvanized steel plate (SECC and the like), and in the same manner as the metal base 51, is formed in a long parallelogram shape in the Y direction in planar view. As shown in FIG. 3, the metal cover 52 is attached to the metal base 51 and forms the accommodating space 68 with the metal base 51. In detail, the metal cover 52 is provided with the upper surface 65 along the X-Y plane that covers the upper surface of the pressure adjustment member 14, an upper surface step portion 67 that is formed in a step shape that is lowered by one step from the end portion of one side in the X direction of the upper surface 65, and two side surfaces 66 that interpose the metal base 51 therebetween and face each other. In other words, the upper surface 65 and the upper surface step portion 67 are formed between the two side surfaces 66. That is, the side surface 66 is a part that extends downward respectively from another side end in the X direction of the upper surface 65 and one side end in the X direction of the upper surface step portion 67. In addition, the upper surface 65 has rigidity to the extent to function as a correction portion that corrects distortion of the flow path member 13 while the flow path member 13 is attached. Note that, the upper surface 65 of the metal cover 52 is equivalent to the fixing portion in the invention.

As shown in FIGS. 2 and 3, a first opening 76 in which the wiring member 11 is inserted is formed on the upper surface step portion 67 of the metal cover 52. The wiring member 11 is inserted into the first opening 76 and the wiring member 11 and the connector 63 of the circuit board 15 are connected further below the first opening 76. Note that, the first opening 76 in the embodiment is formed in a state of an edge that is curved to the exterior. In addition, a second opening 77 into which the liquid outflow ports 42 of the flow path member 13 is inserted and a third opening 78 into which the gas outflow ports 44 of the flow path member 13 are formed on the upper surface 65 of the metal cover 52. That is, the liquid outflow ports 42 of the flow path member 13 are inserted into the second opening 77 and is connected to the liquid inflow port 46 of the pressure adjustment member 14 that is positioned below the second opening 77. In addition, the gas outflow ports 44 of the flow path member 13 are inserted into the third opening 78 and is connected to the gas inflow port 47 of the pressure adjustment member 14 that is positioned below the third opening 78. That is, the first opening 76, the second opening 77, and the third opening 78 are connection ports that link the accommodating space 68 and connect an internal space and an external space of the accommodating space 68.

As shown in FIGS. 2 and 3, a plurality of fragile portions 73 with lower rigidity than the upper surface 65 and the side surface 66 are provided on the lower end portion of both side surfaces 66 of the metal cover 52. The fragile portions 73 in the embodiment are respectively disposed uniformly along the Y direction (in other words, the longitudinal direction of the metal base 51) on the side surface 66. That is, the fragile portions 73 are arranged side by side at an equal pitch on each side surface 66, and a distance between the fragile portion 73 that is positioned at one end in the Y direction and one end of the side surface 66 and a distance between the fragile portion 73 that is positioned at the other end in the Y direction and the other end of the side surface 66 are respectively set to distances at an approximate half pitch. In addition, a through hole 71 into which a metal cover fixing screw 72 (one type of fixing member in the invention) is inserted is established in each fragile portion 73. As shown in FIG. 3, the side surface 66 of the metal cover 52 is fixed to the metal base 51 by fixing the metal cover fixing screw 72 to the metal cover fixing screw hole 70 of the metal base 51 through the through hole 71 of the fragile portion 73 in a state in which the metal base 51 is inserted between the side surfaces 66 that face each other (in other words, a state in which the metal base 51 is interposed between the side surfaces 66). In other words, the metal cover 52 is attached to the metal base 51 by fixing to the metal base 51 of the fragile portions 73. Note that, the metal cover 52 has a ground potential since the metal base 51 and the metal cover 52 are conducted by the metal cover fixing screw 72. That is, the metal base 51 and the metal cover 52 are conducted and joined on the side surface 66 by the metal cover fixing screw 72.

Figure 7:
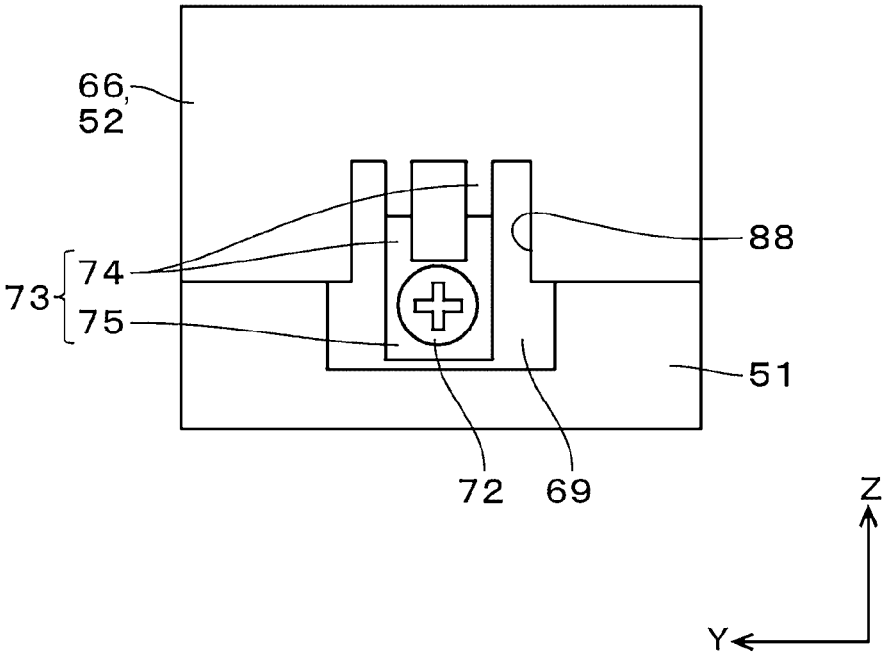
FIG. 7 is a front surface view of the enlarged fixing portion of the fragile portion of the metal cover and the metal base.

FIG. 6 is a sectional view of an enlarged fixing portion of the fragile portions 73 of the metal cover 52 and a metal base 51. FIG. 7 is a front surface view of an enlarged fixing portion of the fragile portions 73 of the metal cover 52 and a metal base 51. The fragile portions 73 in the embodiment extend further outside (lower side) than an end of the lower side (in other words, metal base 51 side) of the side surface 66 in the Z direction (that is, a direction that is orthogonal to a nozzle surface) and extend in the X direction from one side surface 66 toward the other side surface 66 (alternatively, one side surface 66 from the other side surface 66). In short, the fragile portions 73 extend from the side surface 66 toward the lower side and the inside.

Described in further detail, as shown in FIGS. 6 and 7, the fragile portion 73 is formed within a cutout portion 88 in which a portion of the lower end of the side surface 66 is cut out, and consists of two arm portions 74 that extend from the cutout portion 88 toward the lower side and the inside of the side surface 66 and a fixed base portion 75 that is formed on the tip end of the two arm portions 74. The two arm portions 74 are bent in the middle such that the fixed base portion 75 is along a plane (Y-Z plane) on which the metal cover fixing screw hole 70 is formed inside the concave portion 69 of the metal base 51. Then, the through hole 71 into which the metal cover fixing screw 72 is inserted is formed at a position that corresponds to the metal cover fixing screw hole 70 of the fixed base portion 75. Thereby, the fragile portion 73 is fixed inside the concave portion 69 when the metal cover fixing screw 72 is fixed in the metal cover fixing screw hole 70 of the metal base 51 through the through hole 71 in a state in which the fragile portion 73 is accommodated inside the concave portion 69 of the metal base 51. Accordingly, the fragile portion 73 and the metal base 51 are fixed by the metal cover fixing screw 72 further at the other side surface 66 side than the one side surface 66 (alternatively, further on one side surface 66 side than the other side surface 66). In other words, the fragile portion 73 and the metal base 51 are fixed by the metal cover fixing screw 72 further to the inside than the side surface 66. In the fixed state, a part or all of the metal cover fixing screw 72 is accommodated inside the concave portion 69 of the metal base 51. Then, the metal cover 52 is fixed to the metal base 51 by fixing each fragile portion 73 and the concave portions 69 that correspond thereto. Note that, the fragile portion 73 in the embodiment is formed with a narrower width than the width of the concave portion 69 of the metal base 51 (dimension in the Y direction) and a narrower width than the width of the cutout portion 88 of the metal cover 52.

In addition, as shown in FIG. 4, both side surfaces 66 of the metal cover 52 in the embodiment are disposed at positions in the longitudinal direction (Y direction) of the metal base 51 that are deviated from each other along both side surfaces of the metal base 51 formed in a long parallelogram shape in the Y direction. Therefore, viewed from the X direction, both side surfaces 66 do not overlap with both end portions of the metal cover 52 in the Y direction and either becomes only one. That is, viewed from the X direction, a region in which both side surfaces 66 overlap and a region in which both side surfaces 66 do not overlap are formed. Then, since the respective fragile portions 73 are disposed uniformly on both side surfaces 66 with positions deviated from each other, a part or all of the fragile portions 73 are disposed at positions that do not overlap viewed from the X direction. In short, the fragile portions 73 in the embodiment are disposed asymmetrically to a virtual line that passes through the center of the metal cover 52 in the X direction.

Furthermore, as shown in FIG. 3, the dimension between the side surfaces 66 of the metal cover 52 that face each other (that is, the gap between the side surfaces 66) is formed to become larger from the upper surface 65 side (that is, opposite side from the metal base 51) toward the metal base 51 side. In the embodiment, the side surfaces 66 are formed in a state of being slightly inclined to the Y-Z plane so as to gradually become larger from the upper surface 65 side toward the metal base 51 side. In short, in sectional view, an outline of the metal base 51 is formed in a substantially trapezoidal shape. Then, a gap W1 between the side surfaces 66 of the region that corresponds to at least the metal base 51 (that is, the gap W1 of the lower end portion of the side surfaces 66) out of the gap between the side surfaces 66 is formed to be larger than a dimension W2 of the metal base 51 that is interposed between the side surfaces 66. Therefore, a slight gap is formed between the side surface 66 of the metal cover 52 and the metal base 51. Note that, in the embodiment, the thickness of each portion of the metal cover 52 is aligned with a substantially constant thickness.

The liquid ejecting unit 4 is fixed by a screw fastening or an adhesive to the lower surface of the metal base 51 (that is, surface of the medium support portion 6 side) lined up in the Y direction in a state in which the respective relative positions are specified. As shown in FIG. 2, each liquid ejecting unit 4 is provided with a plurality of unit heads 83 (referred to as a head chip), a flow path structure 84 in which the supply flow path (not shown in the drawings) is formed along which ink that is supplied to each unit head 83 flows, and a protective plate 85 that protects each unit head 83. The unit heads 83 are configured such that the configuring members such as a nozzle plate 23 on which the nozzles 24 as will be described later are established, a substrate on which the flow path that is linked to the nozzles 24 is formed, an actuator unit 17 that is a driving source that discharges ink, and the like are laminated. The unit head 83 exhibits a substantially parallelogram shape in planar view from the lower surface of the nozzle plate 23 (surface on the side at which ink is ejected from the nozzles 24). That is, as shown in FIG. 4, a nozzle column 24*a* in which a plurality of nozzles 24 are arranged side by side are provided inclined to the transport direction (X direction) of the recording medium 2 and a side by side direction (Y direction) of the liquid ejecting unit 4, and is formed such that the outline of the unit head 83 that matches the inclination of the nozzle column 24*a* is a substantially parallelogram shape. Note that, the inclination angle of the nozzle column 24*a* is determined according to the formation pitch of the nozzle 24 and the recording resolution in the X direction. In the embodiment, a total of two nozzle columns 24*a* are provided on one unit head 83. Then, in each liquid ejecting unit 4, a total of six unit heads 83 are disposed lined up along the Y direction that is the side by side direction of the liquid ejecting unit 4. Accordingly, in the embodiment, each liquid ejecting unit 4 respectively has 12 nozzle columns 24*a*.

The protective plate 85 is a plate-shaped plate material made from metal common to each unit head 83 that is provided in the liquid ejecting unit 4. A nozzle exposure opening 86 that exposes the nozzle 24 which is formed on the nozzle plate 23 is open to a position that corresponds to the nozzle plate 23 of each unit head 83 on the protective plate 85. The nozzle exposure opening 86 in the embodiment exhibits a long parallelogram shape in the nozzle column direction (Xa direction). Each unit head 83 is joined using adhesive to the upper surface of the protective plate 85 (surface on the opposite side from the medium support portion 6) in a state in which the nozzle 24 is exposed to the corresponding nozzle exposure opening 86.

The flow path structure 84 is a member in which a plurality of members that distribute and supply ink that is sent from the ink cartridge 8 to each unit head 83 that are joined to the lower surface side of the flow path structure 84. A plurality of liquid introduction inlets 60 are established on the upper surface of the flow path structure 84 and ink is introduced to the internal flow path from the liquid introduction inlets 60. In the embodiment, the liquid introduction inlets 60 that correspond to a total of four colors of ink are provided to the flow path structure 84. Filters which are not shown in the drawings are respectively disposed in the middle of the supply flow paths that correspond to each color inside the flow path structure 84, and air bubbles or foreign matter are removed from the ink that flows along the supply flow path. Each supply flow path is branched in a branched flow path of a number according to a number of the unit heads 83 that are provided in the liquid ejecting unit 4 inside the flow path structure 84, and is linked to the liquid introduction path 21 of the plurality of unit heads 83.

Figure 5:
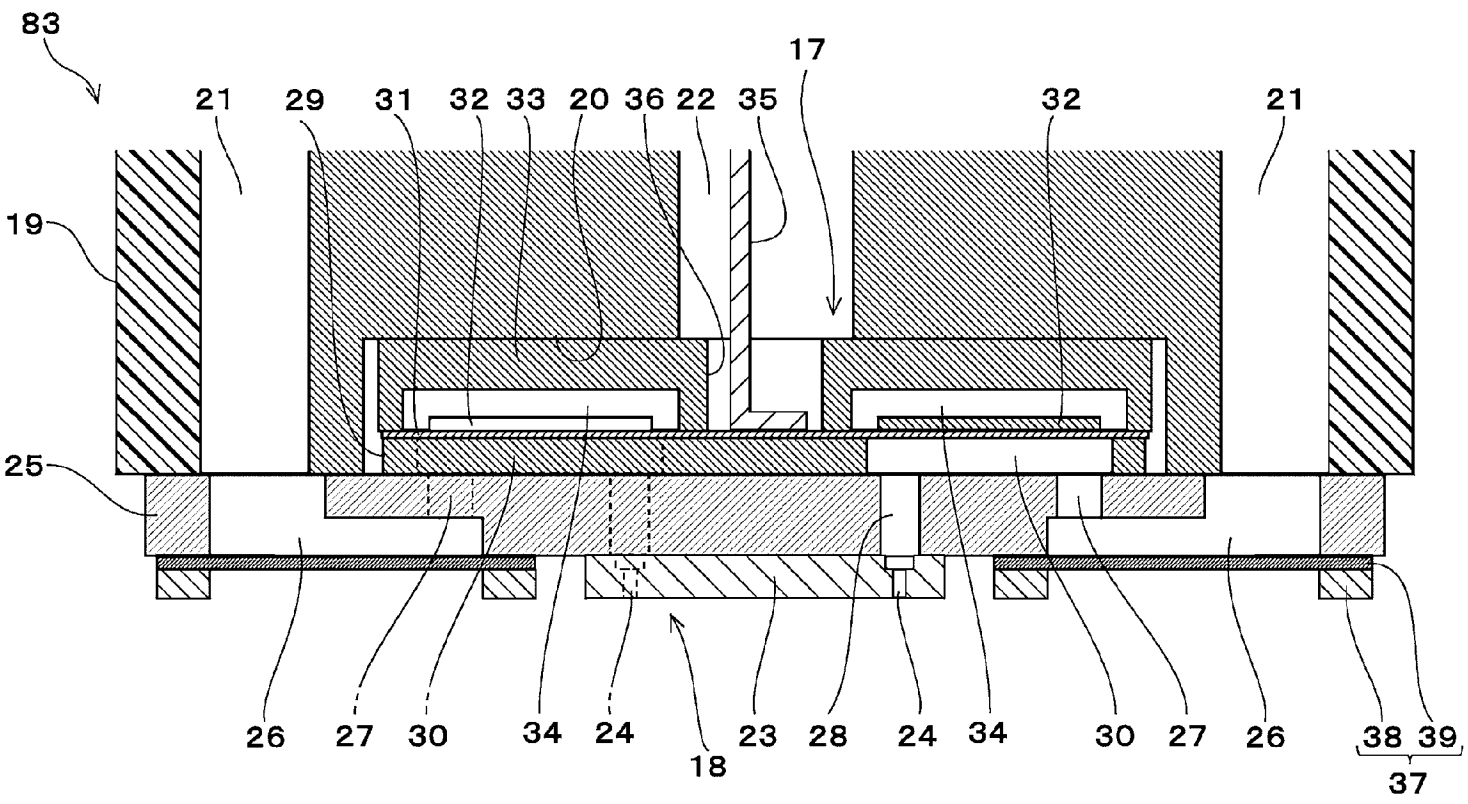
FIG. 5 is a sectional view of a unit head.

FIG. 5 is a sectional view of the unit head 83. As shown in FIG. 5, the unit head 83 in the embodiment is attached to a head casing 19 in a state in which the actuator unit 17 and a flow path unit 18 are laminated.

The head casing 19 in the embodiment is a box-shaped member made of a synthetic resin. As shown in FIG. 5, an actuator accommodation space 20 and a through space 22 that are long spaces along the nozzle column direction are formed in the center portion of the head casing 19. The actuator accommodation space 20 is a space in which the actuator unit 17 is accommodated, and is formed in a state of being concave in the middle in the plate thickness direction from the lower surface (that is, a direction orthogonal to the lower surface) of the head casing 19 by only the thickness of the actuator unit 17. The through space 22 is formed in a state of being linked to a ceiling surface on the top surface side of the actuator accommodation space 20, and passing through the head casing 19 in the plate thickness direction. A flexible substrate 35 that supplies the driving signal to the piezoelectric element 32 (described later) is disposed in the through space 22 and the actuator accommodation space 20. Note that, although illustration is omitted, the flexible substrate 35 extends outside of the unit head 83 from the upper surface opening of the through space 22, and is connected to an aggregate substrate (not illustrated) that is provided in the flow path structure 84. Then, the aggregated substrate is connected to the circuit board 15 via a cable that is not illustrated. For example, the cable is connected to the circuit board 15 through a gap between the metal base 51 and the metal cover 52. In addition, as shown in FIG. 5, the liquid introduction path 21 along which ink flows is formed inside the head casing 19. The lower end of the liquid introduction path 21 is connected to a common liquid chamber 26 which will be described later. In the embodiment, two liquid introduction paths 21 are formed corresponding to the nozzle columns 24*a* which are formed in two columns.

The flow path unit 18 is connected to the lower surface of the head casing 19. The flow path unit 18 is a long substrate along the nozzle column direction that consists of a linking substrate 25, a nozzle plate 23, and a compliance substrate 37 that are laminated. For example, the linking substrate 25 is a substrate that is manufactured from a silicon single crystal substrate. As shown in FIG. 5, the common liquid chamber 26 in which ink is retained common to each pressure chamber 30 and that is linked to the liquid introduction path 21, an individual linking path 27 that individually supplies ink from the common liquid chamber 26 to each pressure chamber 30, and the nozzle linking path 28 that is linked to the pressure chamber 30 and the nozzle 24 are formed on the linking substrate 25 by anisotropic etching. The common liquid chamber 26 is a long space portion along the nozzle column direction and is formed in two columns corresponding to the liquid introduction path 21. A plurality of individual linking paths 27 and the nozzle linking paths 28 are formed along the side by side direction of the pressure chamber 30 (in other words, the nozzle column direction).

The nozzle plate 23 is a substrate made of silicon (for example, a silicon single crystal substrate) that is joined to the lower surface of the linking substrate 25 (that is, surface on the opposite side from a pressure chamber forming substrate 29). The nozzle plate 23 in the embodiment is joined to a region that is separated from the compliance substrate 37 so as not to overlap with the compliance substrate 37. In other words, the nozzle plate 23 is joined to the region that is separated from the opening on the lower surface side of the common liquid chamber 26 of the linking substrate 25. The plurality of nozzles 24 are established on the nozzle plate 23 in a straight line shape (in other words, a column shape) along the longitudinal direction of the nozzle plate 23. That is, the nozzle column 24*a* is formed. The plurality of established nozzles 24 (the nozzle column 24*a*) are uniformly provided at a pitch corresponding to the dot formation density from the nozzle 24 on one end side up to the nozzle 24 on the other end side. Note that, the lower surface of the nozzle plate 23 is equivalent to the nozzle surface in the invention.

The compliance substrate 37 is a substrate that has flexibility that is joined to the region that corresponds to the common liquid chamber 26 on the lower surface of the linking substrate 25. That is, the compliance substrate 37 is joined to the region that does not cover the nozzle plate 23 of the linking substrate 25. The compliance substrate 37 in the embodiment is a substrate on which a sealing film 39 that has flexibility with low rigidity is laminated on a fixed substrate 38 that consists of a rigid material such as metal. The region that faces the common liquid chamber 26 of the fixed substrate 38 is an opening portion that is removed in the thickness direction. Therefore, the lower surface of the common liquid chamber 26 functions as a compliance portion that is sealed by only the sealing film 39 and absorbs pressure variation of ink within the common liquid chamber 26.

As shown in FIG. 5, the actuator unit 17 in the embodiment is a composite substrate formed of laminated substrates such as the pressure chamber forming substrate 29, a vibration plate 31, and a sealing plate 33. The actuator unit 17 is formed in a size to be accommodatable in the actuator accommodation space 20 of the head casing 19, and is accommodated in the actuator accommodation space 20.

For example, the pressure chamber forming substrate 29 is a substrate that is manufactured from a silicon single crystal substrate. A part of the pressure chamber forming substrate 29 is removed from the entirety in the plate thickness direction by anisotropic etching and the like, and a plurality of spaces that are to be the pressure chamber 30 are established along the nozzle column direction. The lower part of the space is partitioned by the linking substrate 25, the upper part is partitioned by the vibration plate 31, and constitutes the pressure chamber 30. In addition, the space, that is, the pressure chamber 30 is formed to be long in a direction orthogonal to the nozzle column direction, the individual linking path 27 is linked to one end portion in the longitudinal direction, and the nozzle linking path 28 is linked to the other end portion. In addition, the plurality of pressure chambers 30 in the embodiment are formed along the nozzle column direction.

For example, the vibration plate 31 is a thin-film member that consists of an elastic film made from silicon dioxide ($SiO_2$) that is formed on the upper surface of the pressure chamber forming substrate 29 (that is, the surface on the opposite side from the linking substrate 25 side) and an insulation film made from zirconium dioxide ($ZrO_2$) that is formed on the elastic film. An upper opening of the space that is to be the pressure chamber 30 is sealed by the vibration plate 31. In other words, the upper surface of the pressure chamber 30 is partitioned by the vibration plate 31. A part which corresponds to the pressure chamber 30 on the vibration plate 31 (in detail, the upper opening of the pressure chamber 30) functions as a displaced portion that is displaced in a direction that is far from the nozzle 24 or in a direction that is close accompanying deflection of the piezoelectric element 32. That is, a region which corresponds to the upper opening of the pressure chamber 30 on the vibration plate 31 is a driving region in which deflection is permissible. Then, the capacity of the pressure chamber 30 is changed by the deflection (displacement) of the driving region (displaced portion). Meanwhile, a region which is separated from the upper opening of the pressure chamber 30 on the vibration plate 31 is a non-driving region in which deflection is inhibited.

The piezoelectric elements 32 (equivalent to driving elements in the invention) are respectively laminated in a region (that is, driving region) which corresponds to each pressure chamber 30 on the upper surface (that is, the surface on the opposite side from the pressure chamber forming substrate 29 side of the vibration plate 31) of the vibration plate 31 (in detail, an insulation film of the vibration plate 31). The piezoelectric element 32 in the embodiment is a piezoelectric element of a so-called deflection mode. The plurality of piezoelectric elements 32 are established along the nozzle column direction corresponding to each nozzle 24. For example, on each piezoelectric element 32, a lower electrode layer that is an individual electrode, a piezoelectric body layer, and an upper electrode layer that is a common electrode are sequentially laminated in order from above the vibration plate 31. Note that, it is also possible for the lower electrode layer to be the common electrode and the upper electrode layer to be the individual electrode according to the circumstance of the driving circuit or the wiring. When the piezoelectric element 32 that is configured in this manner applies an electric field according to potential differences of both electrodes between the lower electrode layer and the upper electrode layer, the piezoelectric element 32 deforms by deflection in the direction that is far from the nozzle 24 or in a direction that is close.

As shown in FIG. 5, the sealing plate 33 is a substrate on which a piezoelectric element accommodation space 34 that is able to accommodate the piezoelectric elements 32 is formed. The sealing plate 33 is joined on the vibration plate 31 in a state in which the piezoelectric elements 32 are accommodated in the piezoelectric element accommodation space 34. In the embodiment, the piezoelectric element accommodation spaces 34 are formed in two columns which correspond to the columns of the piezoelectric elements 32 which are formed in two columns. A connection space 36 in which the sealing plate 33 is removed in the plate thickness direction is formed between the two piezoelectric element accommodation spaces 34. The connection space 36 is linked to the through space 22, and the end portion of the flexible substrate 35 that is inserted in the through space 22 is disposed inside of the connection space 36. Then, the flexible substrate 35 and a lead wiring (not shown in the drawings) that extends from the piezoelectric element 32 are connected in the connection space 36.

Then, the recording head 3 that is configured in the manner above supplies ink inside the individual unit heads 83 via the flow path member 13, the pressure adjustment member 14, and the flow path structure 84 by supplying ink from the ink cartridge 8. The unit head 83 changes the capacity of the pressure chamber 30 by supplying the driving signal from the control portion to the piezoelectric element 32 via the wiring member 11, the circuit board 15, the flexible substrate 35, and the like in a state in which the flow path from the liquid introduction path 21 to the pressure chamber 30 is filled with ink. By using the pressure variation of ink in the pressure chamber 30 accompanying the change of capacity, ink droplets are ejected from the nozzle 24 that is linked to the pressure chamber 30 via the nozzle linking path 28.

Figure 8:
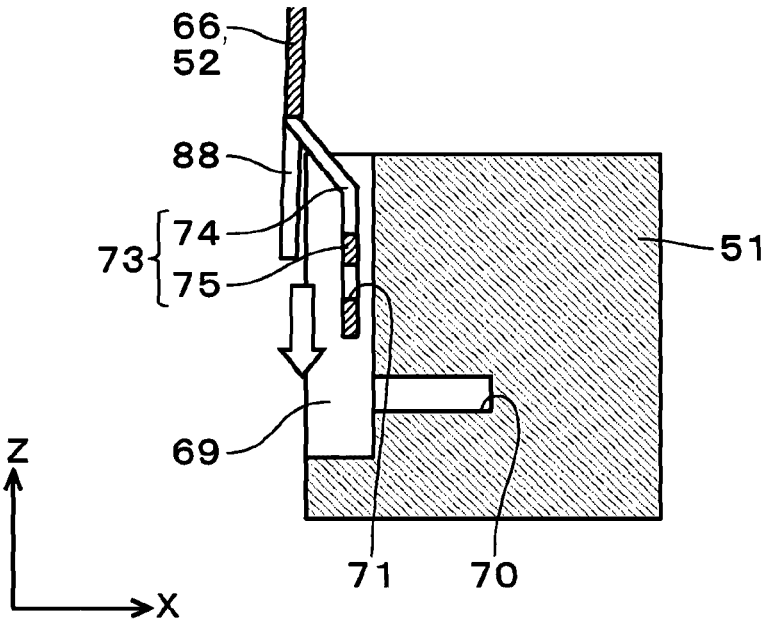
FIG. 8 is a sectional view describing fixing of the fragile portion of the metal cover to the metal base.
Figure 9:
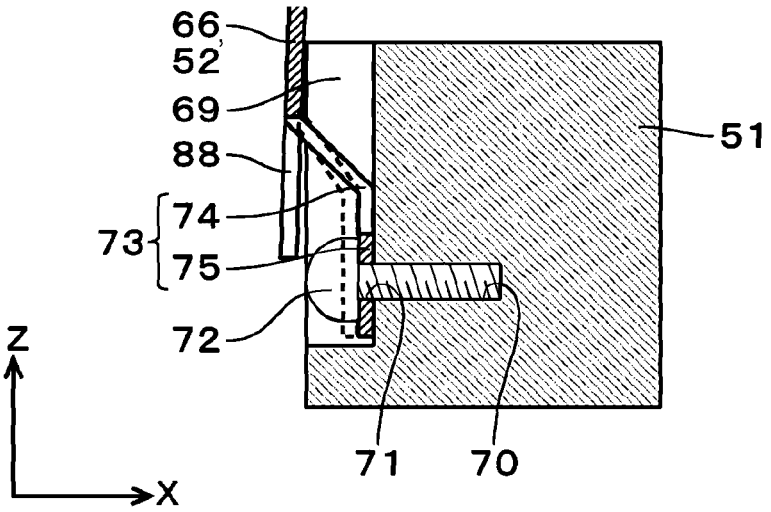
FIG. 9 is a sectional view describing fixing of the fragile portion of the metal cover to the metal base.

Next, the manufacturing method of the recording head 3, and in particular, the fixing method for the metal base 51 of the metal cover 52 will be described in detail. FIG. 8 is a sectional view describing fixing of the fragile portion 73 to the metal base 51. FIG. 9 is a sectional view describing fixing of the fragile portion 73 to the metal base 51. First, the liquid ejecting unit 4 is fixed to the lower surface of the metal base 51, and the pressure adjustment member 14 and the circuit board 15 are fixed to the upper surface (refer to FIG. 2 and the like). In addition, in a flow path member fixing process (equivalent to the laminated member fixing step in the invention), the flow path member 13 is fixed to the upper surface 65 of the metal cover 52. By the fixing, distortion of the flow path member 13 is corrected. In short, the flow path member 13 is made from a synthetic resin, and warping tends to be generated during formation. In addition, in a case where the flow path member 13 fuses a plurality of members, warping is more likely to occur in response to heat during fusing. However, in the embodiment, it is possible to suppress warping of the flow path member 13 since the flow path member 13 is fixed to the upper surface 65 of the metal cover 52 by the flow path member fixing screw 81.

The metal cover 52 is fixed to the metal base 51 if the liquid ejecting unit 4 or the like are fixed to the metal base 51, and the flow path member 13 is fixed to the metal cover 52. In detail, either one of the metal cover 52 or the metal base 51 is relatively moved toward the other end while matching both relative positions. Then, the plurality of liquid outflow ports 42 and the plurality of gas outflow ports 44 of the flow path member 13 that protrudes below the metal cover 52 are connected to the corresponding plurality of liquid inflow ports 46 and the plurality of gas inflow ports 47 of the pressure adjustment member 14. In this case, as shown in FIG. 8, the fragile portions 73 of the metal cover 52 are inserted into the concave portions 69 of the corresponding metal bases 51. Note that, the fragile portion 73 is in a state of being slightly separated from the surface on which the metal cover fixing screw hole 70 is formed in the concave portion 69. That is, as shown by a broken line in FIG. 9, a slight gap is formed between the fragile portion 73 and the surface on which the metal cover fixing screw hole 70 of the concave portion 69 is formed. Then, in this state, the process transitions to the metal cover fixing step (cover member fixing step in the invention). In detail, as shown in FIG. 9, the metal cover fixing screw 72 is inserted into the through hole 71 of the fragile portion 73, and the metal cover fixing screw 72 is tightened in the metal cover fixing screw hole 70 while the fragile portion 73 is deformed inside (that is, the metal base 51 side). When the metal cover fixing screw 72 is tightened until the last in the metal cover fixing screw hole 70, the fragile portion 73 abuts with the side surface of the metal base 51 and is fixed to the metal base 51. In the same manner, the metal cover 52 is fixed to the metal base 51 and the recording head 3 is manufactured by fixing each fragile portion 73 to the metal cover 52.

In this manner, in the manufactured recording head 3, since the flow path member 13 is fixed on the upper surface 65 of the metal cover 52, for example, even if the flow path member 13 is distorted, it is possible to correct distortion of the flow path member 13 using the upper surface 65 of the metal cover 52. Thereby, connection between the flow path member 13 and the pressure adjustment member 14 is easy. That is, since the position tends not to be deviated with respect to the plurality of the liquid outflow ports 42 of the flow path member 13 and the pressure adjustment member 14 of the plurality of gas outflow ports 44, connection between the plurality of liquid outflow ports 42 and the plurality of gas outflow ports 44 and the corresponding plurality of liquid inflow ports 46 and the plurality of gas inflow ports 47 is easy. In addition, it is possible to suppress air bubbles remaining in the liquid flow path since distortion of the liquid flow path inside the flow path member 13 is suppressed. Then, it is possible to suppress the reaction force that is generated by fixing since the metal cover 52 is fixed to the metal base 51 by the fragile portion 73. Thereby, it is possible to suppress force that is applied to the metal base 51 and it is possible to suppress distortion of the metal base 51. In short, for example, when the metal cover that does not have a fragile portion is fixed to the metal base by the metal cover fixing screw, a recovery force that returns the metal cover to original position acts on the metal base, and the metal base deforms very slightly (for example, around several microns to several tens of microns). As a result, there is a concern that the position of the liquid ejecting unit that is attached to the metal base is deviated, and the nozzle position that is established on the nozzle surface of the liquid ejecting unit is deviated. In particular, in the embodiment, when the fixing portion of the metal cover and the metal base are disposed asymmetrically in the X direction, the force acting on the metal base is asymmetrical, and the metal base tends to distort. However, in the invention, since the metal base 51 is fixed by the fragile portion 73, the recovery force of the fragile portion 73 is weak, and it is possible to suppress deformation in the metal base 51. As a result, it is possible to suppress positional deviation of the recording head 3, and thus, it is possible to suppress positional deviation of the nozzle 24.

In addition, in the embodiment, since the gap between both side surfaces 66 is larger than the width of the metal base 51 in the X direction, when the metal base 51 is inserted between the side surfaces 66 and the metal cover 52 is fixed in the metal base 51, it is possible to easily insert the metal base 51 between the side surfaces 66. In particular, in the embodiment, since the gap between both side surfaces 66 is formed to become larger downward, when the metal cover 52 is fixed in the metal base 51, it is possible to more easily insert the metal base 51 between the side surfaces 66. As a result, fixing of the metal cover 52 and the metal base 51 is easy. Furthermore, since the positions in the Y direction of both side surfaces 66 are disposed deviated from each other, the positions in the Y direction may not be aligned and a degree of freedom of design increases.

Furthermore, since the fragile portion 73 in the embodiment is fixed inside the concave portion 69, it is possible to suppress protrusion of the metal cover fixing screw 72 further outside in the X direction than the side surfaces 66. That is, it is possible to reduce (alternatively, eliminate) the amount of protrusion from both side surfaces 66 of the metal cover fixing screw 72. As a result, it is possible to reduce the size of the recording head 3. Additionally, since the fragile portion 73 extends further to the lower side than the lower end of the side surfaces 66, it is possible to suppress spread of the gap of the side surfaces 66 in comparison to the recording head in which the lower end of the side surface extends to the same position as the lower end of the fragile portion. As a result, it is possible to further reduce the size of the recording head 3. In addition, since the fragile portions 73 are disposed uniformly in the Y direction on the respective side surfaces 66, fixing of the metal cover 52 and the metal base 51 is stable. Then, it is possible to provide a gap for absorbing a dimensional error caused by a manufacturing error and the like between the metal base 51 and the fragile portions 73 since the fragile portions 73 are deformed to the metal base 51 side and fixed to the metal base 51. As a result, when the metal cover 52 is fixed in the metal base 51, it is possible to more easily insert the metal base 51 between the side surfaces 66.

In addition, in the recording head 3 in the embodiment, since the circuit board 15 is disposed along the side surfaces 66 of the metal cover 52, it is possible for heat that is generated in the circuit board 15 to escape to the metal cover 52. Furthermore, since the flow path member 13 is fixed on the upper surface 65 of the metal cover 52, it is possible to cool the metal cover 52 using liquid that flows along the flow path member inside the flow path member 13. As a result, it is possible to more effectively perform heat dissipation of the circuit board 15.

Figure 10:
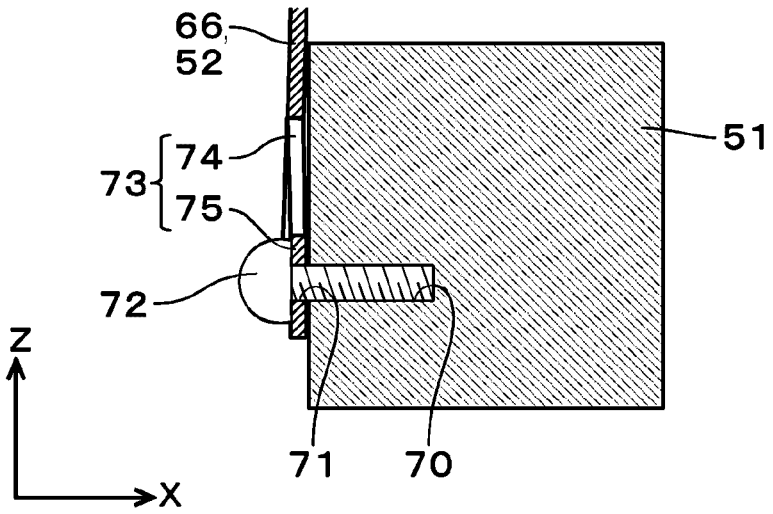
FIG. 10 is a sectional view of an enlarged fixing portion of a fragile portion of a metal cover and a metal base in a second embodiment.
Figure 11:
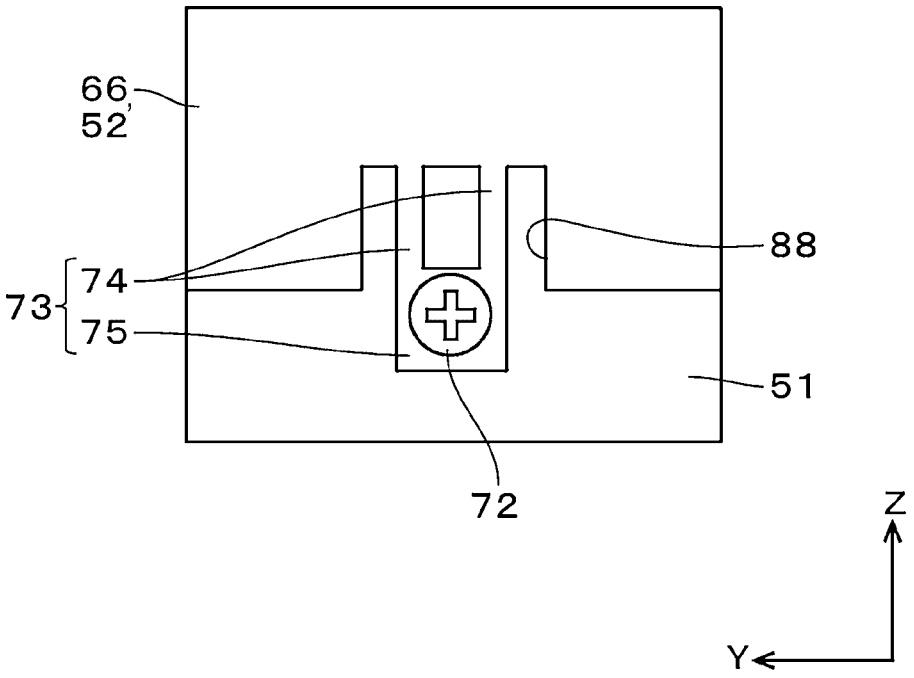
FIG. 11 is a front surface view of the enlarged fixing portion of the fragile portion of the metal cover and the metal base in the second embodiment.

Note that, the shape of the fragile portions 73 is not limited to the shape in the first embodiment described above. In short, the fragile portions 73 may be any shape as long as the rigidity is lower than the upper surface 65 of the metal cover 52. For example, the fragile portion 73 in the second embodiment that is shown in FIGS. 10 and 11 does not extend further toward the inside than the side surface 66 in the X direction, and the lower end of the side surfaces 66 are aligned at substantially the same position. In detail, as shown in FIGS. 10 and 11, the fragile portion 73 in the embodiment consists of two arm portions 74 that extend from the cutout portion 88 toward the lower side of the side surface 66 and the fixed base portion 75 that is formed on the tip end of the two arm portions 74 and on which the through hole 71 is established. In addition, the side surfaces of both sides in the X direction of the metal base 51 in the embodiment is not formed in a concave portion, and are formed to be flat. Furthermore, the metal cover fixing screw hole 70 is formed at a position that corresponds to the fragile portion 73 on the side surface. Therefore, in a state in which the metal base 51 is inserted between both side surfaces 66 of the metal cover 52 and the fragile portion 73 is not fixed to the metal base 51, the fragile portion 73 opens a slight gap between the side surfaces of the metal base 51 and extends along the side surfaces. Then, the fragile portion 73 slightly deforms inside, abuts with the side surfaces of the metal base 51 and is fixed to the metal base 51 by tightening the metal cover fixing screw 72 to the metal cover fixing screw hole 70 through the through hole 71 of the fragile portion 73. Thereby, even in the embodiment, it is possible to suppress distortion of the metal base 51 while correcting distortion of the flow path member 13 using the upper surface 65 of the metal cover 52. Note that, since other configurations are the same as the first embodiment described above, explanation is omitted.

Figure 12:
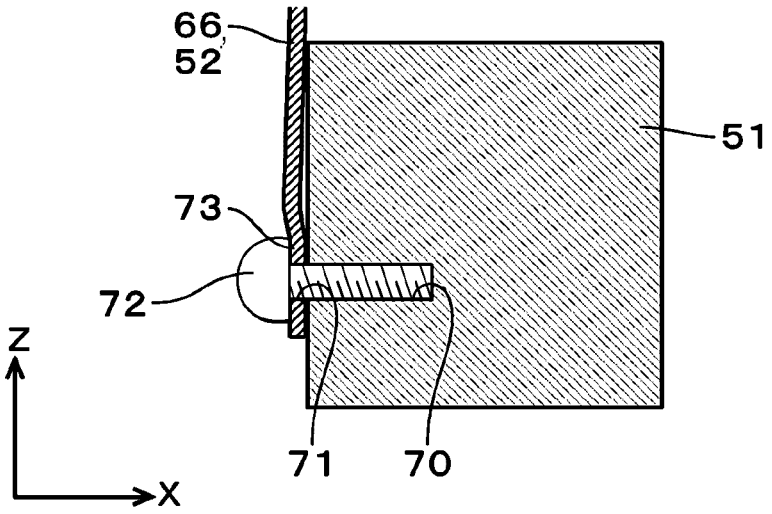
FIG. 12 is a sectional view of an enlarged fixing portion of a fragile portion of a metal cover and a metal base in a third embodiment.
Figure 13:
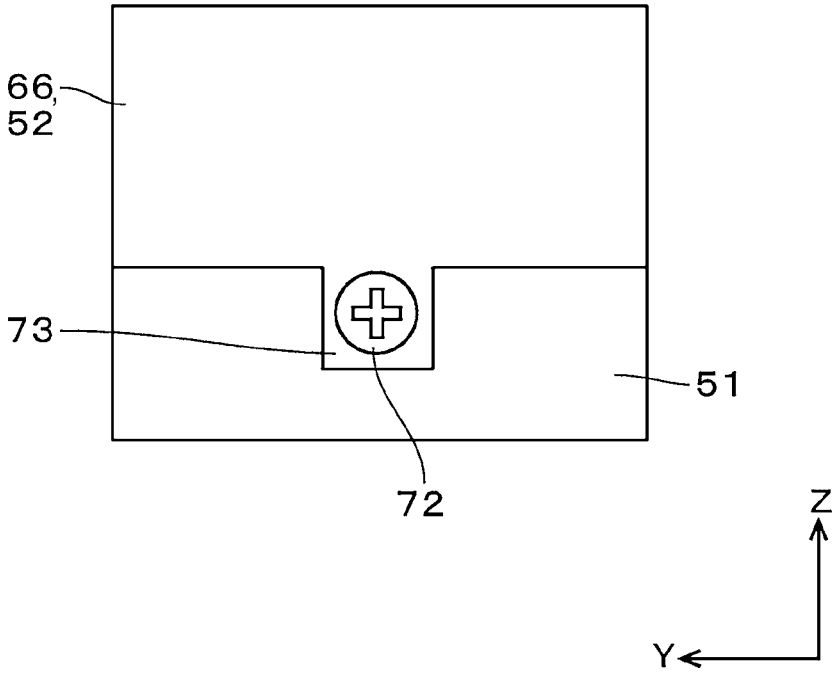
FIG. 13 is a front surface view of the enlarged fixing portion of the fragile portion of the metal cover and the metal base in the third embodiment.

In addition, the fragile portion 73 in a third embodiment shown in FIGS. 12 and 13 is not provided with the arm portion 74, and simply, a portion extends from the lower end of the side surface 66 of the metal cover 52. The width of the fragile portion 73 (that is, the dimension in the Y direction) is formed to be as narrow as possible in a range that it is possible to establish the through hole 71. Therefore, the fragile portion 73 in the embodiment is also able to have low rigidity in comparison to the other portion of the metal cover 52. In addition, the side surfaces of both sides in the X direction of the metal base 51 in the embodiment is formed to be flat in the same manner as in the second embodiment described above. Therefore, in a state in which the metal base 51 is inserted between both side surfaces 66 of the metal cover 52 and the fragile portion 73 is not fixed to the metal base 51, the fragile portion 73 opens a slight gap between the side surfaces of the metal base 51 and extends along the side surfaces. Then, even in the embodiment, the fragile portion 73 slightly changes shape inside, abuts with the side surfaces of the metal base 51 and is fixed to the metal base 51 by tightening the metal cover fixing screw 72 in the metal cover fixing screw hole 70 through the through hole 71 of the fragile portion 73. Thereby, it is possible to suppress distortion of the metal base 51 while correcting distortion of the flow path member 13 using the upper surface 65 of the metal cover 52. Note that, since other configurations are the same as the first embodiment described above, explanation is omitted.

Note that, in the each embodiment described above, the flow path member 13 is fixed to the metal cover 52, but the invention is not limited thereto. For example, the flow path member may be attached to the upper portion of the pressure adjustment member inside the metal cover, and may be provided with a through hole into which a liquid supply tube and a gas supply tube are inserted into the metal cover. By doing this, for example, it is possible to fix an aggregated circuit board to the upper surface of the metal cover as one type of laminated member. Thereby, it is possible to correct distortion of the aggregated circuit board. As a result, connection is easy to the circuit board that is one type of connection member which is disposed below the aggregated circuit board by interposing the upper surface of the metal cover therebetween (in detail, one or a plurality of connectors that are provided on the circuit board). In addition, connection between the metal cover and the laminated member of the flow path member, the aggregated circuit board, or the like is not limited to so-called surface connection in which the upper surface of the metal cover and the lower surface of the laminated member abut. For example, a support pin may protrude to either one of the upper surface of the metal cover and the lower surface of the laminated member, and the support pin may be in so-called point contact abutting with the other of the upper surface of the metal cover and the lower surface of the laminated member. In addition, an intermediate member may be interposed between the metal cover and the laminated member, and the metal cover and the laminated member may be fixed.

In addition, in each embodiment described above, the recording head 3 is formed in a parallelogram shape in planar view, but is not limited thereto. For example, it is also possible to adopt a configuration in which the recording head is formed in a rectangular shape, a square shape, or another polygonal shape in planar view. In a case where the recording head is formed in the rectangular shape or the square shape in planar view, the metal cover and the metal base are formed in the rectangular shape or the square shape in planar view, and the positions are aligned in the longitudinal direction (Y direction) on both side surfaces of the metal cover. In addition, the fragile portion is formed to be symmetrical left and right with respect to a virtual line that passes through the center of the metal cover in a short direction (X direction). By doing this, it is possible for force that acts on the metal base caused by fixing of the fragile portion to be symmetrical left to right and to further suppress distortion of the metal base.

Furthermore, in each embodiment described above, a line head that is provided with a plurality of liquid ejecting units 4 is given as an example of the recording head 3, but the invention is not limited thereto. It is also possible to apply the invention to a liquid ejecting head (so-called serial head) that performs discharge of ink while scanning (reciprocating movement) in the direction (Y direction) which is orthogonal to the transport direction of the recording medium. In such a liquid ejecting head, it is possible to adopt a configuration in which only one liquid ejecting unit is provided. In addition, in either of a line head and a serial head, the number of unit heads that configure the liquid ejecting unit may be one or more. In short, it is possible to apply the invention if a recording head is provided with the metal base to which the liquid ejecting unit is fixed that has one or more unit head and the metal cover that is attached to the metal base. In addition, it is possible to adopt the base member that consists of another member (for example, synthetic resin) as the base member not limited to the metal base 51 made from metal. Furthermore, it is possible to adopt the cover member that consists of another member (for example, synthetic resin) as the cover member not limited to the metal cover 52 made from metal.

In addition, the fragile portion 73 in the first embodiment and the second embodiment described above is provided with two arm portions 74, but the invention is not limited thereto. One or more arm portions may be provided. In addition, it is possible to appropriately set the length (dimension in the Z direction) and the width (dimension in the Y direction) of the arm portion. For example, in a case where it is desirable to further weaken rigidity, it is possible to lengthen the length of the arm portion and narrow the width of the arm portion. Furthermore, the thickness of the fragile portion 73 in each embodiment described above is aligned with the thickness of the side surface 66, but the invention is not limited thereto. For example, it is also possible to further weaken rigidity by making the thickness of the fragile portion thinner than the thickness of the side surface.

Then, above, the ink jet recording head 3 is described as an example of the liquid ejecting head, but the invention is also able to be applied to another liquid ejecting head that is provided with the cover member and the base member. For example, it is also possible to apply the invention to a color material ejecting head which is used in manufacture of a color filter of a liquid crystal display or the like, an electrode material ejecting head that is used in electrode formation such as an organic electro luminescence (EL) display, a field emission display (FED), or the like, a biological organic matter ejecting head which is used in manufacture biochips (bio-chemical element), and the like. A color material ejecting head for the display manufacturing apparatus ejects solution of each color material of red (R), green (G), and blue (B) as one type of liquid. In addition, an electrode material ejecting head for the electrode forming apparatus ejects electrode material in liquid form as one type of liquid, and a bio-organic material ejecting head for the chip manufacturing apparatus ejects a bio-organic material solution as one type of liquid.

What is claimed is:

1. A liquid ejecting head comprising:

a liquid ejecting unit that has a nozzle surface to which the nozzle is open;

a base member to which the liquid ejecting unit is fixed; and a cover member that is attached to the base member and on which a laminated member is laminated, wherein the cover member has a fixing portion to which the laminated member is fixed and a fragile portion that has lower rigidity than the fixing portion, and is attached to the base member by fixing the fragile portion to the base member.

2. The liquid ejecting head according to claim 1, wherein the cover member has side surfaces that face each other interposing the base member therebetween, the fixing portion is formed between the side surfaces that face each other, the fragile portion is formed on the side surfaces, and a gap between side surfaces that face each other is larger than the width of the base member that is interposed between the side surfaces.

3. The liquid ejecting head according to claim 2, wherein the fragile portion that is formed on one side surface out of the side surfaces extends from the one side surface toward another side surface, and the fragile portion formed on the one side surface and the base member are fixed by a fixing member nearer at the other side surface side than the one side surface.

4. The liquid ejecting head according to claim 2, wherein the side surfaces are disposed with positions in a longitudinal direction of the base member deviated from each other, and the fragile portions are disposed uniformly along the longitudinal direction of the base member at each side surface.

5. The liquid ejecting head according to claim 2, wherein the gap between the side surfaces that face each other is formed to become larger from the opposite side from the base member toward the base member side, and the fragile portions extend further outside than the end of the side surfaces on the base member side in a direction that is orthogonal to the nozzle surface.

6. The liquid ejecting head according to claim 1, further comprising:

a connection member between the fixing portion and the base member, wherein the laminated member is connected to the connection member interposing the fixing portion therebetween.

7. The liquid ejecting head according to claim 1, further comprising:

a circuit board that supplies a driving signal to the liquid ejecting unit, wherein the cover member is formed of metal and has a surface along the circuit board, and the laminated member is provided with a liquid flow path along which liquid flows that is supplied to the nozzle.

8. The liquid ejecting head according to claim 1, wherein the cover member has side surfaces that face each other interposing the base member therebetween, the fixing portion is formed between the side surfaces that face each other, and the fragile portion is formed on the side surfaces.

9. The liquid ejecting head according to claim 8, wherein the side surfaces are disposed with positions in a longitudinal direction of the base member deviated from each other.

10. The liquid ejecting head according to claim 9, further comprising:

a connection member between the fixing portion and the base member, wherein the laminated member is connected to the connection member interposing the fixing portion therebetween.

11. The liquid ejecting head according to claim 9, further comprising:

a circuit board that supplies a driving signal to the liquid ejecting unit, and wherein the cover member is formed of metal and has a surface along the circuit board.

12. The liquid ejecting head according to claim 8,

Wherein the fragile portions are disposed uniformly along the longitudinal direction of the base member at each side surface.

13. The liquid ejecting head according to claim 12, further comprising:

a connection member between the fixing portion and the base member, wherein the laminated member is connected to the connection member interposing the fixing portion therebetween.

14. The liquid ejecting head according to claim 12, further comprising:

a circuit board that supplies a driving signal to the liquid ejecting unit, and wherein the cover member is formed of metal and has a surface along the circuit board.

15. The liquid ejecting head according to claim 8, further comprising:

a connection member between the fixing portion and the base member, wherein the laminated member is connected to the connection member interposing the fixing portion therebetween.

16. The liquid ejecting head according to claim 15, further comprising:

a circuit board that supplies a driving signal to the liquid ejecting unit, and wherein the cover member is formed of metal and has a surface along the circuit board.

17. The liquid ejecting head according to claim 8, further comprising:

a circuit board that supplies a driving signal to the liquid ejecting unit, and wherein the cover member is formed of metal and has a surface along the circuit board.

* * * * *